US012440036B2

(12) United States Patent
Wang et al.

(10) Patent No.: US 12,440,036 B2
(45) Date of Patent: Oct. 14, 2025

(54) FOLDABLE AND ADJUSTABLE BEDS

(71) Applicant: Nisco Co., Ltd, Jiangsu (CN)

(72) Inventors: Wei Wang, Jiangsu (CN); Jian Xie, Jiangsu (CN); Fahuan Zhang, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 600 days.

(21) Appl. No.: 17/873,325

(22) Filed: Jul. 26, 2022

(65) Prior Publication Data

US 2022/0354266 A1 Nov. 10, 2022

Related U.S. Application Data

(60) Continuation-in-part of application No. 17/506,052, filed on Oct. 20, 2021, now Pat. No. 12,089,745, which is a division of application No. 16/747,842, filed on Jan. 21, 2020, now Pat. No. 11,178,974, which is a continuation-in-part of application No. 16/729,700, filed on Dec. 30, 2019, now Pat. No. 11,317,729.

(60) Provisional application No. 62/796,172, filed on Jan. 24, 2019, provisional application No. 62/796,154, filed on Jan. 24, 2019, provisional application No. 62/790,583, filed on Jan. 10, 2019, provisional application No. 62/789,047, filed on Jan. 7, 2019, (Continued)

(30) Foreign Application Priority Data

Jul. 26, 2021 (CN) ..... 202121705359.0

(51) Int. Cl.
*A47C 19/12* (2006.01)
*A47C 20/04* (2006.01)

(52) U.S. Cl.
CPC ..... *A47C 20/041* (2013.01); *A47C 19/122* (2013.01)

(58) Field of Classification Search
CPC ..... A47C 20/041; A47C 19/122; A47C 20/04; A47C 19/12
See application file for complete search history.

(56) References Cited

U.S. PATENT DOCUMENTS

2020/0078238 A1* 3/2020 Huang ..... A61G 7/012
2020/0221881 A1* 7/2020 Huang ..... A47C 19/025

(Continued)

FOREIGN PATENT DOCUMENTS

CN 207236519 U * 4/2018 ..... A47C 17/04
CN 209712265 U 12/2019

(Continued)

*Primary Examiner* — Justin C Mikowski
*Assistant Examiner* — Ifeolu A Adeboyejo
(74) *Attorney, Agent, or Firm* — troutman pepper locke; Tim Tingkang Xia, Esq.

(57) ABSTRACT

A foldable bed includes a plurality of boards comprising an upper board, a middle board, and a lower board; a support assembly for supporting the plurality of boards, wherein the support assembly includes a first support structure for supporting the upper board and the middle board, and a second support structure for supporting the lower board; and a pair of connection mechanisms for connecting the first support structure and the second support structure such that the first support structure and the second support structure are pivotally foldable relative to one another at the pair of connection mechanisms.

6 Claims, 6 Drawing Sheets

Related U.S. Application Data provisional application No. 62/789,062, filed on Jan. 7, 2019.

(56) References Cited

U.S. PATENT DOCUMENTS

| | | | | |
|---|---|---|---|---|
| 2022/0361682 | A1* | 11/2022 | Chen | A47C 20/041 |
| 2022/0369822 | A1* | 11/2022 | Ma | A47C 19/122 |
| 2024/0099472 | A1* | 3/2024 | Deng | A47C 20/041 |

FOREIGN PATENT DOCUMENTS

| | | | | | |
|---|---|---|---|---|---|
| CN | 212139978 | U | * | 12/2020 | A47C 19/02 |
| GB | 190906109 | A | * | 2/1910 | A47C 19/122 |
| TW | M583241 | U | * | 5/2019 | A47C 19/12 |
| WO | WO-2021012733 | A1 | * | 1/2021 | A47C 17/04 |
| WO | WO-2022088574 | A1 | * | 5/2022 | A47C 19/12 |

* cited by examiner

FOLDABLE AND ADJUSTABLE BEDS

CROSS-REFERENCE TO RELATED PATENT APPLICATIONS

This application claims priority to and benefit of Chinese Patent Application Serial No. 202121705359.0, filed Jul. 26, 2021, which is incorporated herein in its entirety by reference.

This application is also a continuation-in-part application of U.S. patent application Ser. No. 17/506,052, filed Oct. 20, 2021, which is a divisional application of U.S. patent application Ser. No. 16/747,842 filed Jan. 21, 2020, now U.S. Pat. No. 11,178,974, which itself claims priority to and the benefit of U.S. Provisional Patent Application Ser. Nos. 62/796,154 filed Jan. 24, 2019 and 62/796,172 filed Jan. 24, 2019, and also is a continuation-in-part of U.S. patent application Ser. No. 16/729,700 filed Dec. 30, 2019, now U.S. Pat. No. 11,317,729, which claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to foldable beds with adjustable functions.

BACKGROUND OF THE INVENTION

Sleep is critical for people in every aspect of their lives. Beds are necessary furniture for people to sleep on. A conventional bed usually occupy a relatively large area of the living space for people, and also is not convenient to carry. Thus, it is beneficial and desirable for people to have a bed system that is foldable so as to reduce the space for storage and transportation. In addition, it is also beneficial and desirable that the bed system is capable of adjusting body positions based on user's sleep preference so that the user achieves maximum comfort during sleep.

SUMMARY OF THE INVENTION

In one aspect, the invention relates to a foldable bed. The foldable bed includes a plurality of boards comprising an upper board, a middle board, and a lower board; a support assembly for supporting the plurality of boards, wherein the support assembly includes a first support structure for supporting the upper board and the middle board, and a second support structure for supporting the lower board; and a pair of connection mechanisms for connecting the first support structure and the second support structure such that the first support structure and the second support structure are pivotally foldable relative to one another at the pair of connection mechanisms.

In one embodiment, the first support structure is a rectangular frame structure comprising a pair of first side rails, an upper rail and a lower rail. The pair of first side rails is transversely spaced and longitudinally aligned. Two ends of the upper rail are connected to the pair of first side rails at their upper ends, and two ends of the lower rail are connected to the pair of first side rails at their lower ends. The upper board has a lower edge portion hinged to the lower rail of the first support structure.

In one embodiment, the second support structure comprises a pair of second side rails on which the lower board is attached. The pair of second side rails is respectively corresponding to the pair of first side rails of the first support structure, and is pivotally connected to the pair of first side rails through the pair of connection mechanisms.

In one embodiment, each connection mechanism comprises a connection bracket having a top portion, and a first side tab and a second side tab vertically extended from two opposite ends of the top portion so as to define a notched receptacle between the top portion, the first side tab and the second side tab. Each of the first and second side tabs has first and second through holes spatial-apart formed therein.

In one embodiment, the notched receptacle has a width defined between the first side tab and the second side tab.

In one embodiment, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket.

In one embodiment, each connection mechanism further comprises first and second support sleeves. The first support sleeve is disposed between the first side tab of the connection bracket and the outer side of the lower end of one of the pair of first side rails of the first support structure, and the second support sleeve is disposed between the second side tab of the connection bracket and the inner side of the upper end of one of the pair of second side rails of the second support structure, so that the pair of first side rails of the first support structure is located between two longitudinal extension lines of the pair of second side rails of the second support structure when the foldable bed is not folded.

In one embodiment, the foldable bed further includes a back lifting assembly comprising a back lifting bracket pivotally connected to the first support structure, and at least one back lifting actuator pivotally connected between the back lifting bracket and the first support structure for operably driving the back lifting bracket to pivotally move in an upward rotating direction or a downward rotating direction relative to the first support structure.

In one embodiment, the back lifting bracket comprises a pair of swing arms and a middle bar. The pair of swing arms is transversely spaced and longitudinally extended, and rigidly connected to two ends of the transversely extending middle bar in an H-shaped form, and each of the pair of swing arms has a first end portion and an opposite, second end portion, wherein the first end portion of each swing arm is pivotally mounted to a respective one of the pair of first side rails of the first support structure through a pivot.

In one embodiment, the at least one back lifting actuator comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation, wherein the motor member is pivotally connected to the upper rail of the first support structure and the second end portion of the activation rod pivotally connected to the middle bar of the back lifting bracket. Alternatively, the motor member is pivotally connected to the middle bar of the back lifting bracket and the second end portion of the activation rod pivotally connected to the upper rail of the first support structure.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
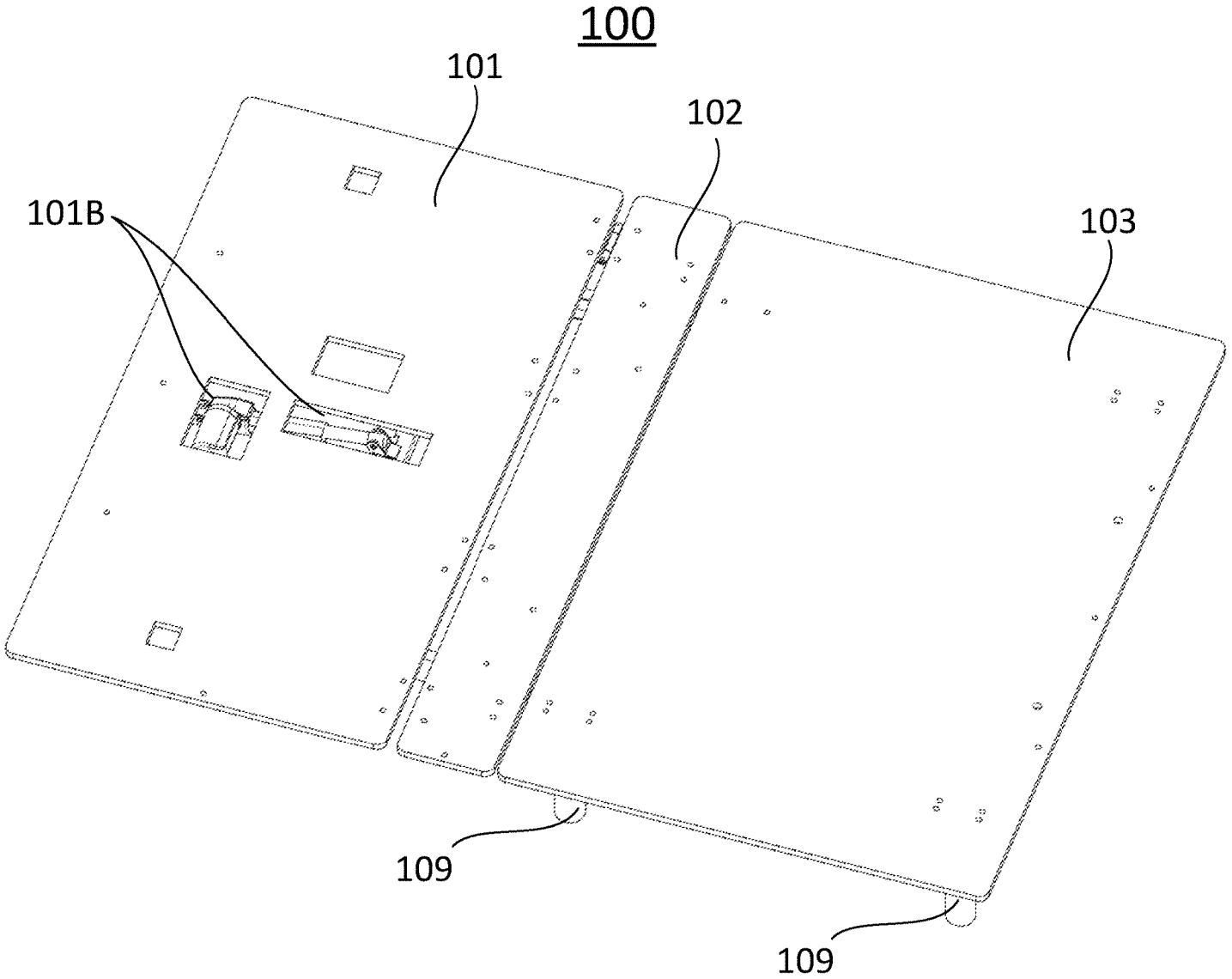
FIG. 1 shows a top perspective view of a foldable and adjustable bed with bed platforms/boards in a flat state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the term "board" or "platform" refers to a bed board or a bed panel.

As used in this specification, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-3, 4A-4C, 5-6 and 7A-7B. In accordance with the purposes of this invention, as embodied and broadly described herein, this invention, in one aspect, relates to a foldable and adjustable beds with foldable connection mechanisms.

Referring to FIGS. 1-3, 4A-4C, 5-6 and 7A-7B, the foldable and adjustable bed 100 is shown according to one embodiment of the invention.

The foldable and adjustable bed 100 includes a plurality of boards comprising an upper board 101, a middle board 102, and a lower board 103; and a support assembly for supporting the plurality of boards. The support assembly includes a first support structure 110 for supporting the upper board 101 and the middle board 102, and a second support structure 120 for supporting the lower board 102.

Figure 2:
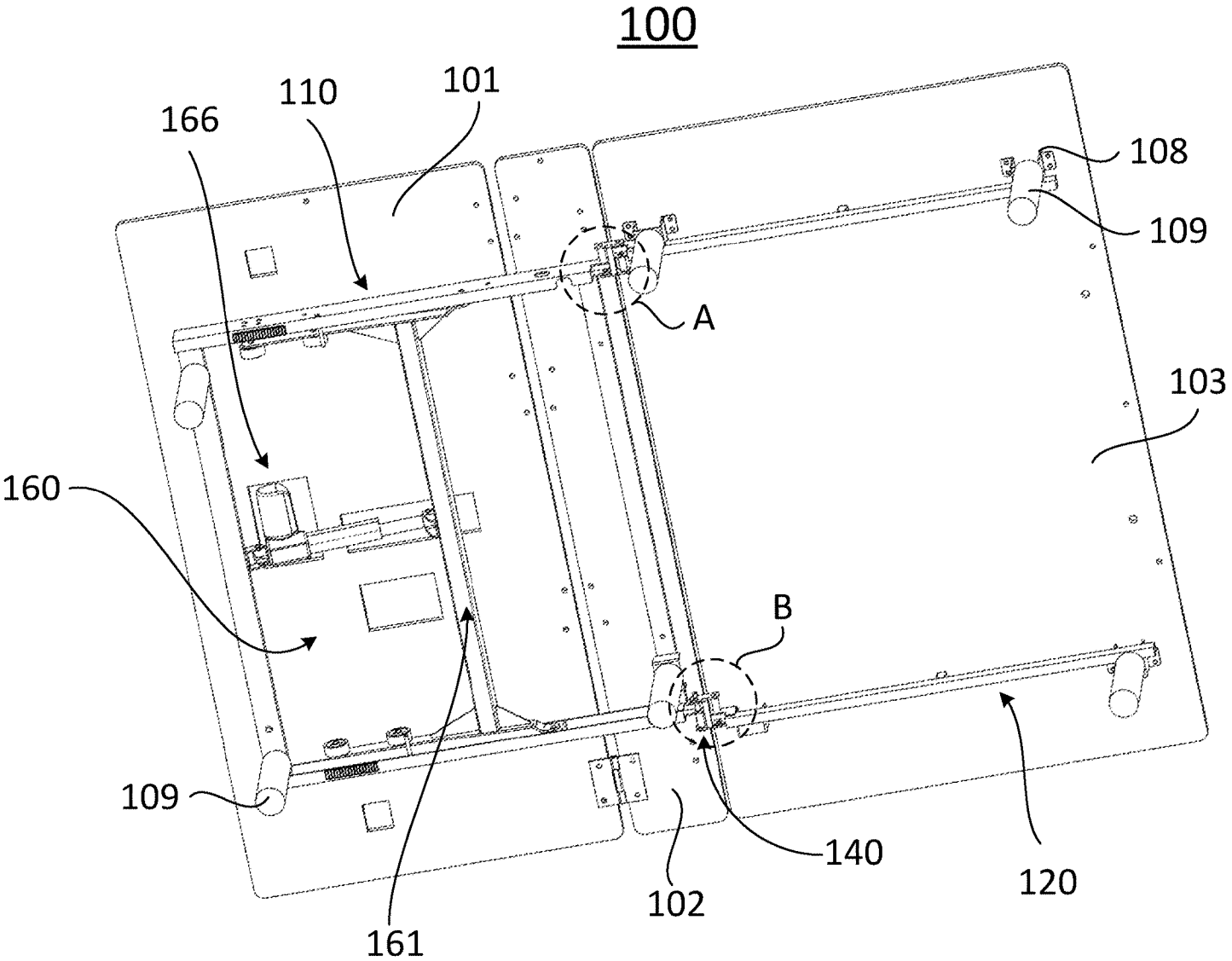
FIG. 2 shows a bottom perspective view of the foldable and adjustable bed shown in FIG. 1.
Figure 3:
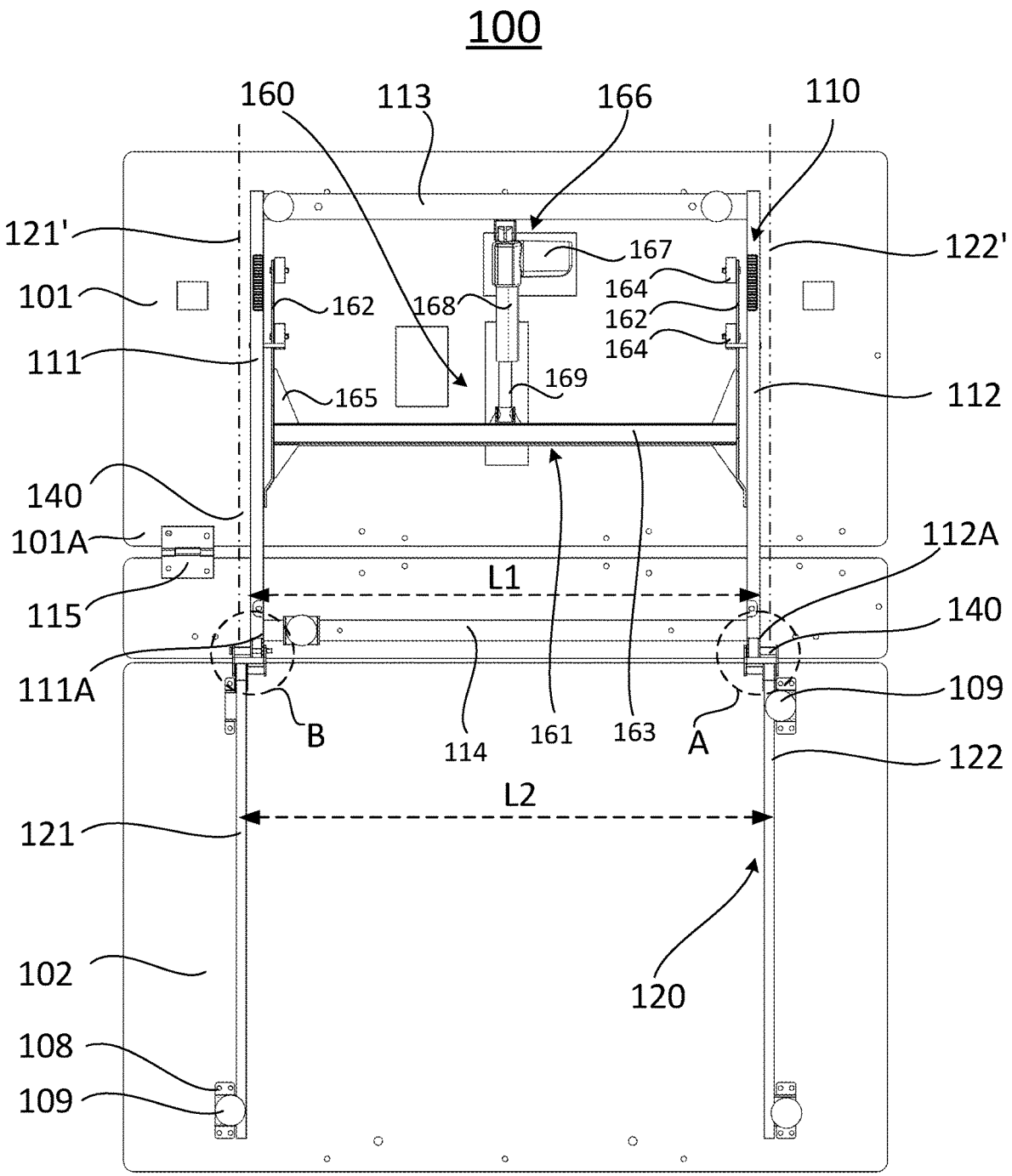
FIG. 3 shows a bottom plan view of the foldable and adjustable bed shown in FIG. 1.
Figure 6:
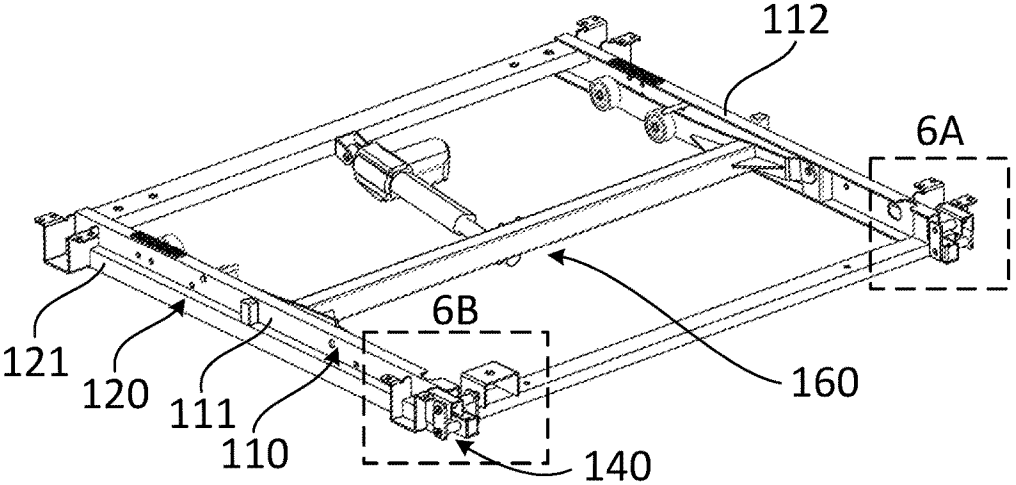
FIG. 6 shows a perspective view of the support assembly with driving and connection mechanisms of the foldable and adjustable bed shown in FIG. 1 in the folded state.

The first support structure 110 in this exemplary embodiment is a rectangular frame structure comprising a pair of first side rails 111 and 112, an upper rail 113 and a lower rail 114, as shown in FIGS. 2-3 and 6. The pair of first side rails 111 and 112 is transversely spaced and longitudinally aligned, defining a width, L1, of the first support structure 110 therebetween. Two ends of the upper rail 113 are fixedly connected to the pair of first side rails 111 and 112 at their upper ends, respectively. Two ends of the lower rail 114 are fixedly connected to the pair of first side rails 111 and 112 at their lower ends 111A and 112A, respectively. The fixed connections between the first side rails 111 and 112, the upper rail 113 and the lower rail 114 can be achieved by any fixed connection means such as welding means, molding means, screwing means, mating connections, or the likes.

The second support structure 120 comprises a pair of second side rails 121 and 122 that is respectively corresponding to the pair of first side rails 111 and 112 of the first support structure 110, and is pivotally connected to the pair of first side rails 111 and 112 through the pair of connection mechanisms 140. As shown in FIGS. 2-3, the pair of second side rails 121 and 122 is also transversely spaced and longitudinally aligned to define a width, L2, of the second support structure 120 therebetween. As shown in FIG. 3, the width L1 of the first support structure 110 is less than the width L2 of the second support structure 120, and the pair of first side rails 111 and 112 of the first support structure 110 are located between two longitudinal extension lines 121' and 122' of the pair of second side rails 121 and 122 of the second support structure 120. Additionally, as shown in FIGS. 4A-4B, 6 and 7A-7B, each first side rail 111/112 has a cutout 115 at its lower end 111A/112A, and each second side rail 121/122 has a cutout 125 at its upper end 121A/122A.

In addition, each of the first and second support structures 110 and 120 is provided with one or more mounting brackets 108 for securing one or more bed posts 109 and the corresponding one of the upper, middle and lower boards 101, 102 and 103.

The middle board 102 is fixedly attached to the first side rails 111 and 112 of the first support structure 110 proximal to their lower end portions 111A and 112A. The upper board 101 has a lower edge portion 101A hinged to the middle board 102, such that the upper board is operably rotatable around the lower edge portion 101A in an upward or downward rotation direction, so as to adjust the angle of the upper board 101, thereby adjusting the back position and angle of a user at user's preference. In addition, the upper board 101 may have one or more openings 101B for operably accommodating the back lifting actuator 166.

The lower board 103 is attached on the pair of second side rails 121 and 122 of the second support structure 120. In one embodiment, the lower board 103 is fixedly attached on the pair of second side rails 121 and 122 of the second support structure 120. In another embodiment, the lower board 103 is movably attached on the pair of second side rails 121 and 122 of the second support structure 120.

The foldable and adjustable bed 100 also includes a pair of connection mechanisms 140 for connecting the first support structure 110 and the second support structure 120 such that the first support structure 110 and the second support structure 120 are pivotally foldable relative to one another at the pair of connection mechanisms 140.

Each connection mechanism 140 comprises a connection bracket 140A having a top portion 143, and a first side tab 141 and a second side tab 142 vertically extended from two opposite ends of the top portion 143 so as to define a notched receptacle 144 between the top portion 143, the first side tab 141 and the second side tab 142. The notched receptacle 144 has a width, W, defined between the first side tab 141 and the second side tab 142. Each of the first and second side tabs 141 and 142 has first and second through holes 145 and 146 spatial-apart formed therein.

Figure 4B:
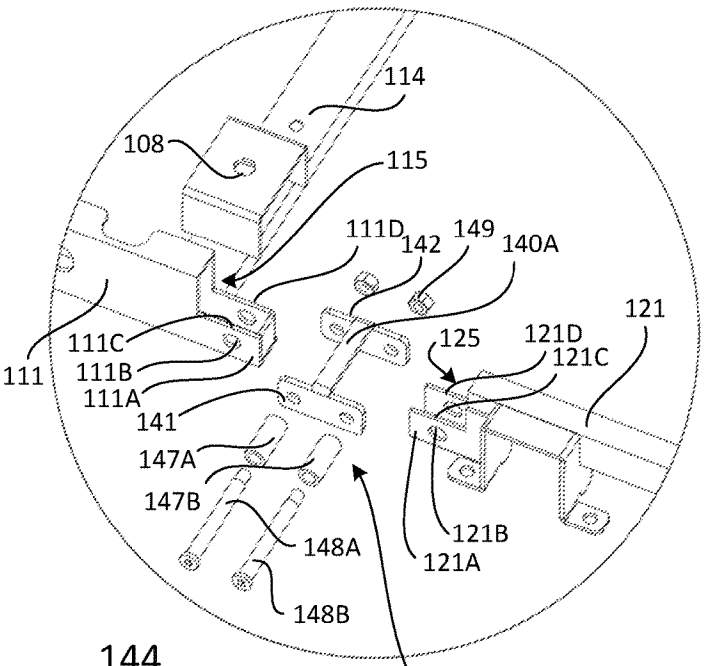
FIG. 4B shows an exploded view of section B of the foldable and adjustable bed shown in FIGS. 2 and 3.
Figure 4C:
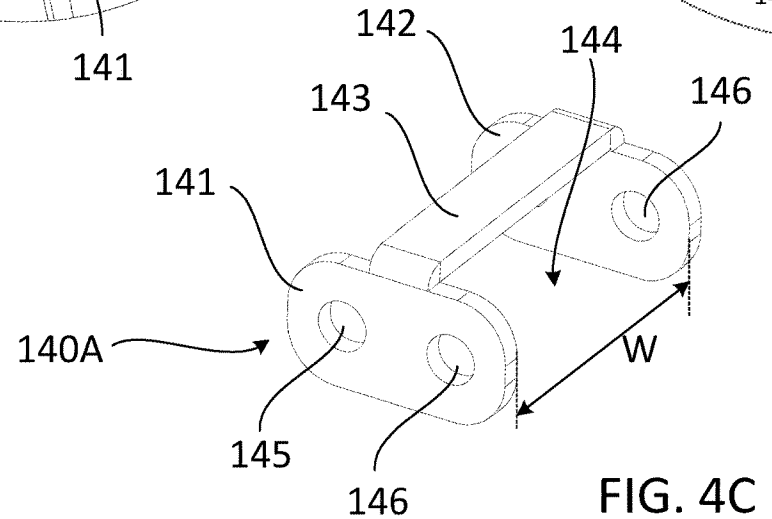
FIG. 4C shows a perspective view of a connection bracket used in the foldable and adjustable bed according to one embodiment of the invention.
Figure 4A:
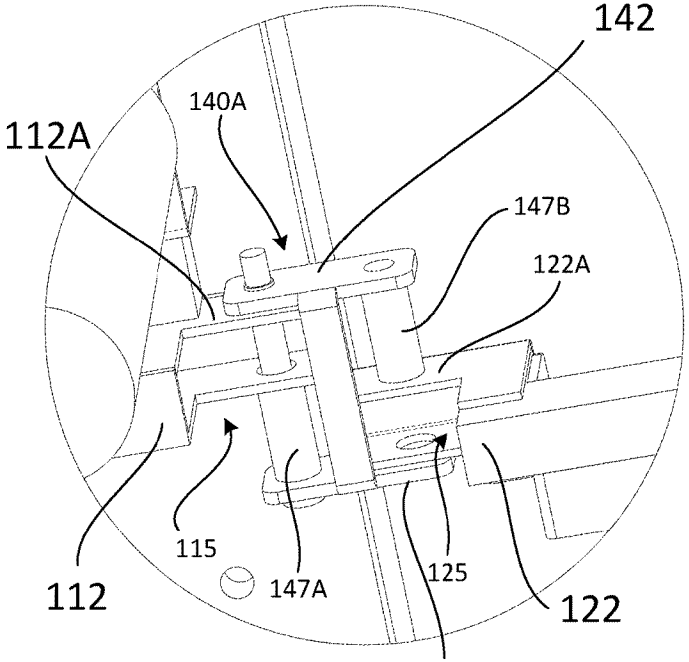
FIG. 4A shows an enlarged view of section A of the foldable and adjustable bed shown in FIGS. 2 and 3.
Figure 5:
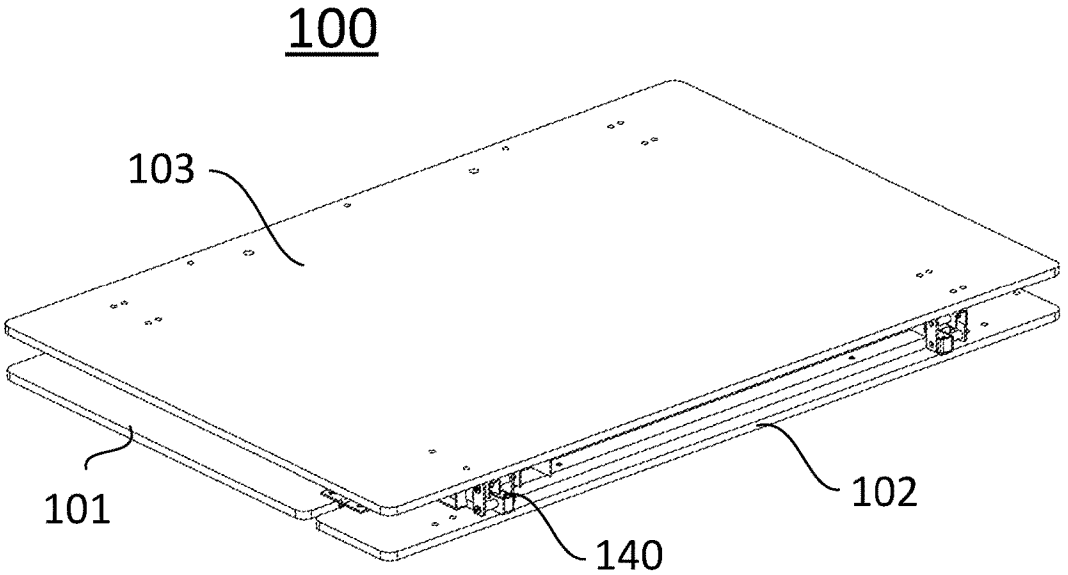
FIG. 5 shows a perspective view of the foldable and adjustable bed shown in FIG. 1 in a folded state.

Referring to FIG. 4B, as assembled, the lower end 111A of the first side rail 111 of the first support structure 110 is received in the notched receptacle 144 of the connection bracket 140A and pivotally connected to the connection bracket 140A through the first through holes 145 of the first and second side tabs 141 and 142 of the connection bracket 140A and the through hole 111B of the lower end 111A of the first side rail 111. The upper end 121A of the second side rail 121 of the second support structure 120 is received in the notched receptacles 144 of the connection bracket 140A and pivotally connected to the connection bracket 140A through the second through holes 146 of the first and second side tabs 141 and 142 of the connection bracket 140A and the through hole 121B of the lower end 121A of the second side rail 121.

In addition, the first and second support sleeves 147A and 147B are provided in the connection mechanism 140.

Specifically, the first support sleeve 147A is disposed between the first side tab 141 of the connection bracket 140A and the outer side 111C of the lower end 111A of the first side rail 111 of the first support structure 110. A first pin 148A is adapted to pass sequentially through the first through hole 145 of the first side tab 141 of the connection bracket 140A, the first support sleeve 147A, the through hole 111B of the lower end 111A of the first side rail 111, and the first through hole 145 of the second side tabs 142 of the connection bracket 140A, and is then secured at the second side tab 142 of the connection bracket 140A, with a nut 149, or other means, e.g., a lock pin. As such, the first support sleeve 147A is located between the first side tab 141 of the connection bracket 140A and the lower end 111A of the first side rail 111 that is in turn located between the first support sleeve 147A and the second side tab 142 of the connection bracket 140A, the first side tab 141 of the connection bracket 140A is in contact with one end of the first support sleeve 147A, while the second side tab 142 of the connection bracket 140A is in contact with the inner side 111D of the lower end 111A of the first side rail 111. Preferably, the sum of the width of the lower end 111A of the first side rail 111 and the length of the first support sleeve 147A is substantially same as or very slightly less than the width W of the notched receptacles 144 of the first connection bracket 140A, such that the notched receptacles 144 of the first connection bracket 140A can accommodate the lower end 111A of the first side rail 111 and the first support sleeve 147A tightly therein, but still allows the lower end 111A of the first side rail 111 to rotate around the first pin 148A.

The second support sleeve 147B is disposed between the second side tab 142 of the connection bracket 140A and the inner side 121D of the upper end 121A of the second side rail 121 of the second support structure 120. A second pin 148B is adapted to pass sequentially through the second through hole 146 of the first side tabs 141 of the connection bracket 140A, the through hole 121B of the upper end 121A of the second side rail 121, the second support sleeve 147B, and the second through hole 146 of the second side tabs 142 of the connection bracket 140A, and is then secured at the second side tab 142 of the connection bracket 140A, with a nut 149, or other means, e.g., a lock pin. As such, the upper end 121A of the second side rail 121 is located between the first side tab 141 of the connection bracket 140A and the second support sleeve 147B that is in turn located between the upper end 121A of the second side rail 121 and the second side tab 142 of the connection bracket 140A, the first side tab 141 of the connection bracket 140A is in contact with the outer side 121C of the upper end 121A of the second side rail 121, while the second side tab 142 of the connection bracket 140A is in contact with one end of the second support sleeve 147B. Preferably, the sum of the width of the upper end 121A of the second side rail 121 and the length of the second support sleeve 147B is substantially same as or very slightly less than the width W of the notched receptacles 144 of the first connection bracket 140A, such that the notched receptacles 144 of the first connection bracket 140A can accommodate the upper end 121A of the second side rail 121 and the second support sleeve 147B tightly therein, but still allows t the upper end 121A of the second side rail 121 to rotate around the second pin 148B.

Similarly, another first side 112 of the first support structure 110 is pivotally connected with another second side rail 122 of the second support structure 120 through another one of the pair of connection mechanisms 140.

By using the pair of connection mechanisms 140 to connect the first and second support structures 110 and 120, the first support structure 110 and the second support structure 120 are foldable to each other in an upper space above the upper and middle boards 101 and 102, while either the first support structure 110 or the second support structure 120 cannot rotate or be folded in a lower space below the upper and middle boards 101 and 102 since the top portion 143 of each connection bracket 140A functions as a rotation limitation to prevent each of the first support structure 110 and the second support structure 120 from rotating toward the lower space below the upper and middle boards 101 and 102.

Figure 7B:
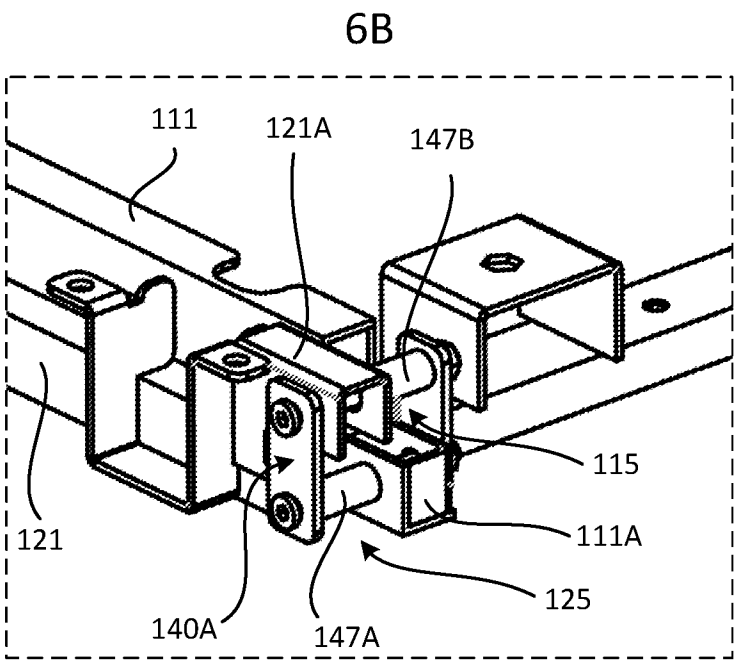
FIG. 7B shows an enlarged view of section 6B of the foldable and adjustable bed shown in FIG. 6.
Figure 7A:
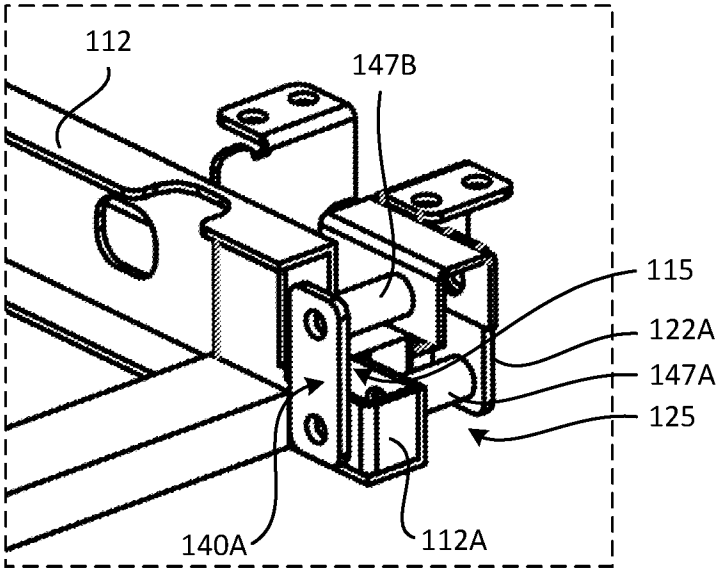
FIG. 7A shows an enlarged view of section 6A of the foldable and adjustable bed shown in FIG. 6.

In addition, by the arrangement of the first and second supporting sleeves 147A and 147B, the width L1 of the first support structure 110 is about the total length of the first and second supporting sleeves 147A and 147B less than the width L2 of the second support structure 120, and when not folded (FIGS. 1-3), the pair of first side rails 111 and 112 of the first support structure 110 is located between the longitudinal extension lines 121' and 122' of the pair of second side rails 121 and 122 of the second support structure 120, as shown in FIG. 3. Accordingly, when folded (FIGS. 5-6), as shown in FIGS. 6 and 7A-7B, the first and second support sleeves 147A and 147B of each connection bracket 140A are respectively received in the cutouts 125 and 115 of the upper end 121A/122A of each second side rail 121/122 of the second support structure 120 and the lower end 111A/112A of each first side rail 111/112 of the first support structure 110, and the first support structure 110 is located inside the second support structure 120, thereby reducing the folded thickness of the folded foldable bed, and greatly reducing the space for storage and/or transportation.

Furthermore, the foldable bed 100 also includes a back lifting assembly 160 comprising a back lifting bracket 161 pivotally connected to the first support structure 110, and a back lifting actuator 166 pivotally connected between the back lifting bracket 161 and the first support structure 110 for operably driving the back lifting bracket 161 to pivotally move in an upward rotating direction or a downward rotating direction relative to the first support structure 110, thereby adjusting the position and angle of the upper board 101 that is pivotally connected to the first support structure 110, which in turn adjusts the position and angle of the back of a user at user's preference.

The back lifting bracket 161 comprises a pair of swing arms 162 and a middle bar 163. The pair of swing arms 162 is transversely spaced and longitudinally extended, and rigidly connected to two ends of the transversely extending middle bar 163. Each of the pair of swing arms 162 has a first end portion pivotally mounted to a respective one of the pair of first side rails of the first support structure through a pivot. In addition, each swing arm 162 is provided with one or more rollers 164, such that when the back lifting bracket 161 is driven to lift up or put down, the one or more rollers rotatably moves on the bottom surface of the upper board 101, which makes the adjustment of the position and angle of the upper board 101 smoothly. In some embodiments, the reinforcement bars 165 are rigidly formed between the swing arms 162 and the middle bar 163 to strengthen the connections therebetween. In one exemplary embodiment shown in FIG. 3, the back lifting bracket 161 is in an H-shaped form. It should be noted that other forms of the back lifting bracket 161 can also be utilized to practice the invention.

The back lifting actuator 166 comprises a motor member 167, an outer tube 168 extending from the motor member 168, and an activation rod 169 having a first end portion received in the outer tube 168 and an opposite, second end portion. The activation rod 169 is engaged with the motor member 167 and configured to be telescopically movable relative to the outer tube 168 according to a direction of motor rotation. In one embodiment shown in FIG. 3, the motor member 167 is pivotally connected to the upper rail 113 of the first support structure 110 and the second end portion of the activation rod 169 pivotally connected to the middle bar 163 of the back lifting bracket 161. In another embodiment (not shown), the motor member 167 is pivotally connected to the middle bar 163 of the back lifting bracket 161 and the second end portion of the activation rod 169 pivotally connected to the upper rail 113 of the first support structure 110.

By using the back lifting assembly 160, the position and angle of the upper board (i.e., back board) 101 can be adjusted according to the user's preference. For example, when the activation rod 169 is driven by the motor member 167 from a retracted state to an extended state, the back lifting bracket 161 rotates around the pivot accordingly to lift up the back board 101 from a flat position (e.g., FIGS. 1-3) to an adjusted position (not shown). Otherwise, when the activation rod 169 is driven by the motor member 167 from the extended state to the retracted state, the back lifting bracket 161 rotates around the pivot accordingly to put down the back board 101 from the adjusted position to the flat position.

In certain embodiments, the foldable and adjustable bed 100 may further include a leg lifting assembly configured to adjust the position and angle of the lower board 103 that includes a thigh board hinged to the second support structure 120 and a leg board hinged to the thigh board.

In certain embodiments, the second support structure 120 further comprises an upper rail and a lower rail, in addition to the pair of third side rails 131 and 132. Two ends of the upper rail are rigidly connected to the pair of third side rails 131 and 132 at their upper ends, and two ends of the lower rail are rigidly connected to the pair of third side rails 131 and 132 at their lower ends. In one embodiment, the thigh board is hinged to the upper rail of the third support structure with one or more hinges.

Slimier to the back lifting assembly 160 disclosed above, the leg lifting assembly may comprise a leg lifting bracket pivotally connected to the second support structure 120, and a leg lifting actuator pivotally connected between the leg lifting bracket and the second support structure 120 for operably driving the leg lifting bracket to pivotally move in an upward rotating direction or a downward rotating direction relative to the second support structure 120, thereby adjusting the position and angle of the thigh board and the leg board, which in turn adjusts the position and angle of the thigh and legs of a user at user's preference.

In certain embodiments, the leg lifting bracket may comprise a pair of swing arms and a middle bar, wherein the pair of swing arms is transversely spaced and longitudinally extended, and rigidly connected to two ends of the transversely extending middle bar in an H-shaped form, and each of the pair of swing arms has a first end portion pivotally mounted to a respective one of the pair of second side rails 121 and 122 of the second support structure 120 through a pivot.

In certain embodiments, the leg lifting actuator may comprises a motor member, an outer tube extending from the motor member, and an activation rod having a first end portion received in the outer tube and an opposite, second end portion. The activation rod is engaged with the motor member and configured to be telescopically movable relative to the outer tube according to a direction of motor rotation. The motor member is pivotally connected to the lower rail of the second support structure 120 and the second end portion of the activation rod pivotally connected to the middle bar of the leg lifting bracket. Alternatively, the motor member is pivotally connected to the middle bar of the leg lifting bracket and the second end portion of the activation rod pivotally connected to the lower rail of the second support structure 120.

In certain embodiments, the upper edge portion of the thigh board is hinged to the upper rail of the second support structure with one or more hinges, and the lower edge portion of the thigh board is hinged to the leg board. The thigh board is supported by the leg lifting bracket, while the leg board is supported by a pair of leg support bar that is pivotally connected to the second side rails of the second support structure.

By using the leg lifting assembly, the position and angle of the thigh and leg boards can be adjusted according to the user's preference. For example, when the activation rod is driven by the motor member from a retracted state to an extended state, the leg lifting bracket rotates around the pivot accordingly to lift up the thigh and leg boards from a flat position to an adjusted position. Otherwise, when the activation rod is driven by the motor member from the extended state to the retracted state, the back lifting bracket rotates around the pivot accordingly to put down the thigh and leg boards from the adjusted position to the flat position.

In sum, the invention provides a bed system that is capable of adjusting body positions based on user's sleep preference so that the user achieves maximum comfort during sleep, and also is foldable so as to reduce the space for storage and transportation.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A foldable bed, comprising:

a plurality of boards comprising an upper board, a middle board, and a lower board;

a support assembly for supporting the plurality of boards, wherein the support assembly includes a first support structure for supporting the upper board and the middle board, and a second support structure for supporting the lower board, wherein the first support structure comprises a pair of first side rails, each first side rail having a cutout at its lower end, and the second support structure comprises a pair of second side rails, each second side rail having a cutout at its upper end; and a pair of connection mechanisms for connecting the first support structure and the second support structure such that the first support structure and the second support structure are pivotally foldable relative to one another at the pair of connection mechanisms, wherein each connection mechanism comprises:

a connection bracket having a top portion, and a first side tab and a second side tab vertically extended from two opposite ends of the top portion to define a notch receptacle between the top portion, the first side tab and the second side tab, each of the first and second side tabs having first and second through holes spatial-apart formed therein; and first and second support sleeves;

wherein, as assembled, the lower ends of the pair of first side rails of the first support structure are respectively received in the notched receptacles of the pair of connection brackets and pivotally and respectively connected to the pair of connection brackets through the first support sleeve and the first through hole of each connection bracket, with the first support sleeve located between the first side tab of each connection bracket and the lower end of each first side rail that is in turn located between the first support sleeve and the second side tab of each connection bracket; and the upper ends of the pair of second side rails of the second support structure are respectively received in the notched receptacles of the pair of connection brackets and pivotally and respectively connected to the pair of connection brackets through the second support sleeve and the second through hole of each connection bracket, with the upper end of each second side rail located between the first side tab of each connection bracket and the second support sleeve that is in turn located between the upper end of each second side rail and the second side tab of each connection bracket, such that when not folded, the pair of first side rails of the first support structure is located between two longitudinal extension lines of the pair of second side rails of the second support structure, and when folded, the first and second support sleeves of each connection bracket are respectively received in the cutouts of the upper end of each second side rail of the second support structure and the lower end of each first side rail of the first support structure, and the first support structure is located inside the second support structure, thereby reducing a folded thickness of the foldable bed.

2. The foldable bed of claim 1, wherein the first support structure is a rectangular frame structure further comprising an upper rail and a lower rail, wherein the pair of first side rails is transversely spaced and longitudinally aligned, wherein two ends of the upper rail are connected to the pair of first side rails at their upper ends, and two ends of the lower rail are connected to the pair of first side rails at their lower ends, and wherein the upper board has a lower edge portion hinged to the lower rail of the first support structure.

3. The foldable bed of claim 1, wherein the notched receptacle has a width defined between the first side tab and the second side tab.

4. The foldable bed of claim 2, further comprising a back lifting assembly comprising a back lifting bracket pivotally connected to the first support structure, and at least one back lifting actuator pivotally connected between the back lifting bracket and the first support structure for operably driving the back lifting bracket to pivotally move in an upward rotating direction or a downward rotating direction relative to the first support structure.

5. The foldable bed of claim 4, wherein the back lifting bracket comprises a pair of swing arms and a middle bar, wherein the pair of swing arms is transversely spaced and longitudinally extended, and rigidly connected to two ends of the transversely extending middle bar, and each of the pair of swing arms has a first end portion and an opposite, second end portion, wherein the first end portion of each swing arm is pivotally mounted to a respective one of the pair of first side rails of the first support structure through a pivot.

6. The foldable bed of claim 5, wherein the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the upper rail of the first support structure and the second end portion of the activation rod pivotally connected to the middle bar of the back lifting bracket, or wherein the motor member is pivotally connected to the middle bar of the back lifting bracket and the second end portion of the activation rod pivotally connected to the upper rail of the first support structure.

* * * * *